US005306189A

United States Patent [19]

Sugimura et al.

[11] Patent Number: 5,306,189

[45] Date of Patent: Apr. 26, 1994

[54] CATHODE IMPREGNATED BY AN ELECTRON EMISSIVE SUBSTANCE COMPRISING (PBAO.QCAO).NBAA1204, WHERE P>1, Q>0, N>1

[75] Inventors: Toshikazu Sugimura; Maki Narita, both of Shiga, Japan

[73] Assignee: Nec Corporation, Japan

[21] Appl. No.: 947,413

[22] Filed: Sep. 18, 1992

[30] Foreign Application Priority Data

Sep. 18, 1991 [JP] Japan ..... 3-237736

[51] Int. Cl.[5] ..... H01J 9/04

[52] U.S. Cl. ..... 445/50; 313/346 DC

[58] Field of Search ..... 445/50, 51; 313/346 DC

[56] References Cited

U.S. PATENT DOCUMENTS 3,358,178 12/1967 Figner et al. ..... 313/346
4,165,473 8/1979 Falce ..... 313/346
5,096,450 3/1992 Sugimura et al. ..... 445/50

*Primary Examiner*—Kenneth J. Ramsey
*Attorney, Agent, or Firm*—Ostrolenk, Faber, Gerb & Soffen

[57] ABSTRACT

An impregnated cathode including an electron emissive substance in a porous matrix of a metal having a high melting point and a heat resistive property, is manufactured by mixing (S2) powder of the metal and the electron emissive substance in a dry state into cathode forming powder, press-shaping (S3) the cathode forming powder into a shaped body, sealing (S4) the shaped body in a reaction vessel to provide a sealed vessel, and subjecting (S5) the shaped body in the sealed vessel to a hot isostatic press (HIP) to provide a sintered body of the cathode forming powder, wherein the substance comprises a barium aluminate compound represented by a chemical formula of:

$$(pBaO.qCaO).nBaAl_2O_4,$$

where p represents an integer which is not less than one, q representing an integer which is not less than zero, n representing an integer which is not less than one. Preferably, the HIP is carried out at a temperature between 900° C. and 1400° C. for twenty minutes with the sealed vessel placed in an argon atmosphere of 1500 atmospheres. The cathode preferably includes the substance in a ratio which is greater than 5.7% by weight and is not greater than 13.8% by weight.

28 Claims, 4 Drawing Sheets

CATHODE IMPREGNATED BY AN ELECTRON EMISSIVE SUBSTANCE COMPRISING (PBAO.QCAO).NBAA1204, WHERE P>1, Q>0, N>1

BACKGROUND OF THE INVENTION

This invention relates to a method of manufacturing an impregnated cathode and to an impregnated cathode manufactured by the method.

An impregnated cathode is preferred in a thermoelectronic tube, such as a highly reliable microwave tube for use in satellite communication, a linear accelerator, or a highly resolving image pickup or display tube which is under progress for new media. The impregnated cathode includes an electron emissive or emission active substance in a porous matrix of a refractory metal and has a high emission current density and a long life. It is believed that this is because a monoatomic layer of free barium is formed as a thermoelectron emissive surface of the cathode and is quickly replenished by diffusion of the electron emissive substance from the matrix.

The impregnated cathode may be an impregnated dispenser cathode disclosed in U.S. Pat. No. 3,358,178 issued to Avraam I. Figner and two others or in U.S. Pat. No. 4,165,473 issued to Louis R. Falce and assigned to Varian Associates, Inc., California. In the manner which will later be described a little more in detail, the conventional method of manufacturing such as impregnated cathode is defective.

An improved method of manufacturing an impregnated cathode is therefore revealed in U.S. Pat. No. 5,096,450 issued to Toshikazu Sugimura, the present inventor, and four others. According to the improved method, powder of an electron emissive substance is first prepared by mixing powder of barium carbonate, calcium carbonate, and aluminium oxide into fixed powder, firing the mixed powder into fired powder, and crushing the fired powder into the powder of the electron emissive substance. Metal powder of a high melting point and a heat resistive property and the powder of the electron emissive substance are now mixed in a dry state into cathode forming powder. The cathode forming powder is press-shaped into a shaped body. The shaped body is sealed in a glass reaction vessel and is subjected to a hot isostatic pressing (HIP) treatment with the sealed vessel placed in an argon atmosphere of a substantially constant final temperature between 1000° C. and 1300° C. and of 1500 atmospheres (atm) for ninety minutes. The shaped body is thereby changed to a sintered body of the cathode forming powder.

It is possible with the improved method to remove the defects of the conventional method. The instant inventor has, however, found that barium oxide is liable to react with tungsten used as the metal during the hot isostatic press treatment to become barium tungstate ($BaWO_4$) if used as the electron emissive substance. This adversely affects formation of the monoatomic layer of free barium. Furthermore, the inventor has found that carbon in a carbonate reacts with tungsten during the hot isostatic press treatment to become tungsten carbide (WC). This reaction takes place if barium carbonate were included in the electron emissive substance although the electron emissive substance includes theoretically no barium carbonate. If formed, the tungsten carbide adversely affects the reduction reaction which is indispensable for thermoelectron emission and is otherwise duly caused by the tungsten included in the sintered body as a matrix.

SUMMARY OF THE INVENTION

It is consequently an object of the present invention to provide a method of manufacturing an impregnated cathode, which method is not complicated.

It is another object of this invention to provide a method which is of the type described and which can be carried out in a relatively short interval of time.

It is still another object of this invention to provide a method which is of the type described and by which it is possible to suppress undesired production of barum tungstate.

Other objects of this invention will become clear as the description proceeds.

On setting forth the gist of an aspect of this invention, it is possible to understand that a method of manufacturing an impregnated cathode comprises the steps of mixing metal powder of a high melting point and a heat resistive property and an electron emissive substance in a dry state into cathode forming powder, press-shaping the cathode forming powder into a shaped body, sealing the shaped body in a reaction vessel to provide a sealed vessel, subjecting the shaped body in the sealed vessel to a hot isostatic press treatment to change the shaped body to a sintered body of the cathode forming powder, and machining the sintered body into the impregnated cathode.

According to the above-mentioned aspect of this invention, the electron emissive substance comprises in the above-mentioned method a barium aluminate compound represented by a chemical formula of:

$$(pBaO.qCaO).nBaAl_2O_4,$$

where p represents an integer which is not less than one, q representing an integer which is not less than zero, n representing an integer which is not less than one.

On setting forth the gist of a different aspect of this invention, it is possible to understand that an impregnated cathode comprises a porous matrix of a metal having a high melting point and a heat resistive property, and an electron emissive substance impregnating the porous matrix.

According to the different aspect of this invention, the electron emissive substance of the above-understood impregnated cathode comprises a barium aluminate compound represented by a chemical formula of:

$$(pBaO.qCaO).nBaAl_2O_4,$$

represents an integer which is not less than one, q representing an integer which is not less than zero, n representing an integer which is not less than one.

According to a further different aspect of this invention, there is provided an impregnated cathode manufactured by the method set forth in the first-mentioned aspect of this invention.

DESCRIPTION OF THE PREFERRED EMBODIMENT

Figure 1:
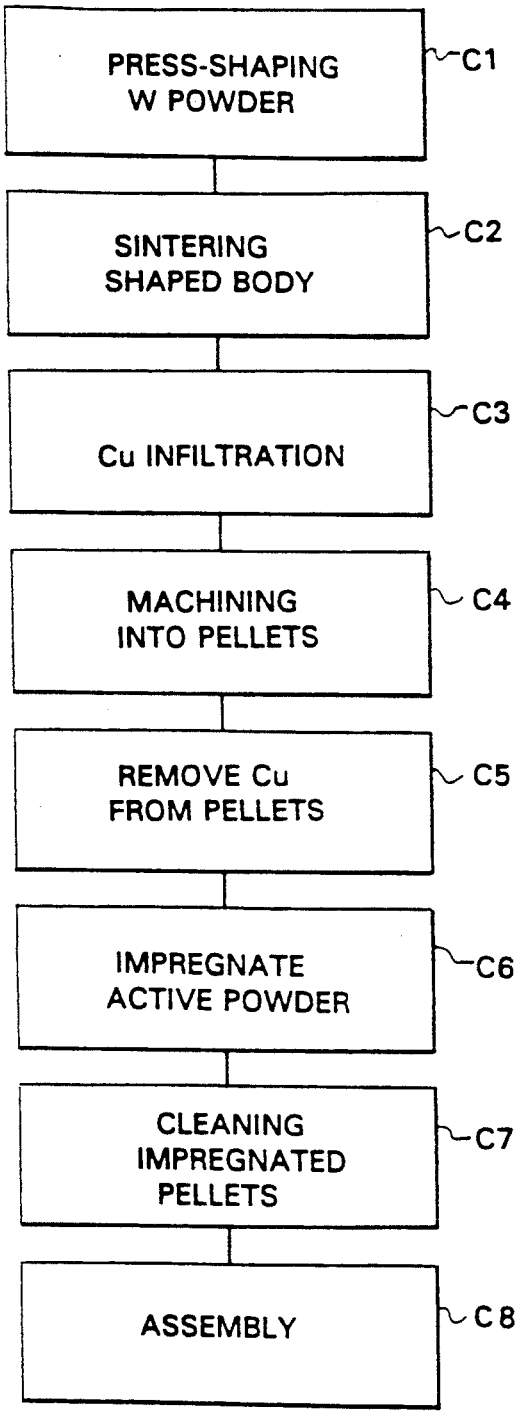
FIG.1 PRIOR ART
FIG. 1 is a flow chart for use in describing a conventional method of manufacturing an impregnated cathode.

Referring to FIG. 1, a conventional method of manufacturing an impregnated cathode will first be described in order to facilitate an understanding of the present invention. The impregnated cathode includes an electron emissive or emission active substance in a porous matrix of a refractory metal.

At a first step C1, tungsten powder is press-shaped into a shaped body having a rod shape. The tungsten powder is used as metal powder of a high melting point and a heat resistive property and has an average powder diameter of several microns. At a second step C2, the shaped body is sintered into a sintered body in a hydrogen atmosphere at a temperature of 2500° C. The sintered body serves as the porous matrix. At a third step C3, the sintered body is embedded in copper (Cu) powder and heated to a melting point of copper to provide a copper infiltrated body. This copper infiltration is for giving a high mechanical strength to the infiltrated body. At a fourth step C4, the copper infiltrated body is machined into copper infiltrated pellets. At a fifth step C5, the copper infiltrated pellets are heated in vacuum to the melting point of copper to melt copper away from the copper infiltrated pellets. This provides porous pellets, which are used as follows.

In the meantime, powder of the electron emissive substance is prepared by mixing powders of barium carbonate, of calcium carbonate, and of aluminium oxide. At a sixth step C6, the porous pellets are impregnated by the electron emissive substance in a hydrogen atmosphere at a temperature between 1600° C. and 1800° C. to provide impregnated pellets. At a seventh step C7, the impregnated pellets are brushed, polished, and cleaned to remove surplus electron emissive substance which inevitably attaches to a surface of each impregnated pellet. This provides an impregnated cathode, which can be used at an eighth step C8 of assembly.

The conventional method is complicated and is troublesome to carry out. Furthermore, each step is time-consuming. The impregnated cathode is therefore expensive when manufactured by the conventional method. In addition, a reduction reaction may excessively take place because the electron emissive substance is impregnated at as high a temperature as 1600° C. through 1800° C.

In contrast, the improved method of U.S. Pat. No. 5,096,450 is astonishingly simple. According to the improved method, the electron emissive substance is either barium oxide (BaO) or at least one barium aluminate compound which does not necessarily consist of barium oxide, calcium oxide (CaO), and barium aluminate ($BaAl_2O_4$) but may consist of only calcium oxide and barium aluminate. It has been found by the present inventor in the manner pointed out heretobefore that barium tungstate is undesiredly formed if barium oxide is used as the electron emissive substance. Furthermore, it has been confirmed that the electron emissive substance should include barium oxide in the barium aluminate compound or compounds.

Figure 2:
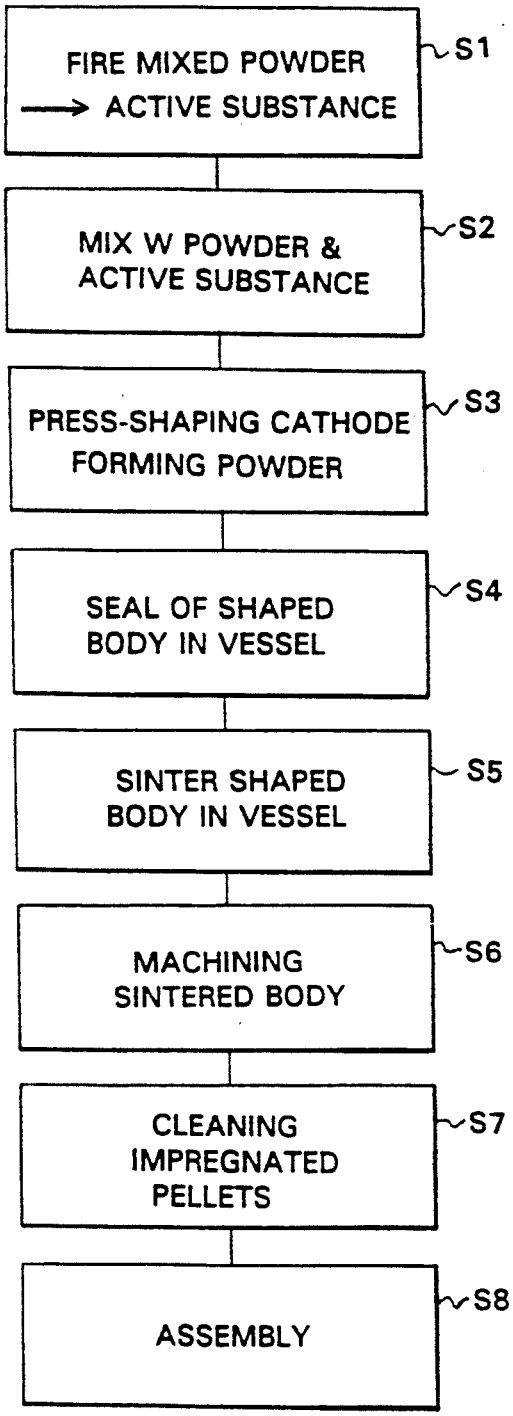
FIG. 2 is a flow chart for use in describing a method which is for manufacturing an impregnated cathode and which is according to an embodiment of the instant invention.

Referring now to FIG. 2, the description will proceed to a method according to a preferred embodiment of this invention, which method is for use in manufacturing an impregnated cathode. In the manner described in the foregoing, the impregnated cathode includes an electron emissive or emission active substance in a porous matrix of a refractory metal. For manufacture of the impregnated cathode by the method being illustrated, tungsten (W) powder of an average powder diameter of 2 to 10 microns was used as metal powder having a high melting point and a heat resistive property.

At a first step S1, the electron emissive substance was prepared by first mixing barium carbonate ($BaCO_3$) powder, calcium carbonate ($CaCO_3$) powder, and aluminium oxide ($Al_2O_3$) powder into mixed powder. In the mixed powder, the mol ratio was 4:1:1. The mixed powder was fired in air at 1100° C. for five to ten hours to provide at least one barium aluminate compound for use as the electron emissive substance. According to the improved method revealed in the Sugimura et al patent referred to hereinabove, the barium aluminate compound or compounds are preliminarily crushed by ball milling into powder. Crushing may or may not be preliminarily carried out in the method according to this invention.

The barium aluminate compounds were $Ba_5CaAl_4O_{12}$, $Ba_3Al_2O_6$, $Ba_5Al_2O_8$, $Ba_7Al_2O_{10}$, $Ba_{10}Al_2O_{13}$, and the like. It is therefore possible to represent the barium aluminate compound or compounds by a chemical formula of:

$$(pBaO.qCaO).nBaAl_2O_4,$$

where p represents an integer which is not less than one, q representing an integer which is not less than zero, n representing an integer which is not less than one. This chemical formula will be called together with limitations on the integers p, q, and n, a general chemical formula in the following, with the barium aluminate compound or compounds referred to simply as a barium aluminate compound.

At a second step S2, the tungsten powder and the electron emissive substance were mixed into cathode forming powder in a dry state known in the art. By this dry mixing, the electron emissive substance was given an average powder diameter of from 0.1 micron to 2.0 microns. One hundred grams of the tungsten powder and 6 grams of the electron emissive substance were mixed to provide the cathode forming powder. The barium aluminate compound was 5.7 percent by weight in the cathode forming powder.

At a third step S3, the cathode forming powder was press-shaped into a shaped body. In the example being illustrated, the cathode forming powder was subjected to rubber press of about 2 tons per square centimeter. The shaped body had a rod shape. During this press shaping, it is unnecessary to heat the cathode forming powder.

Figure 3:
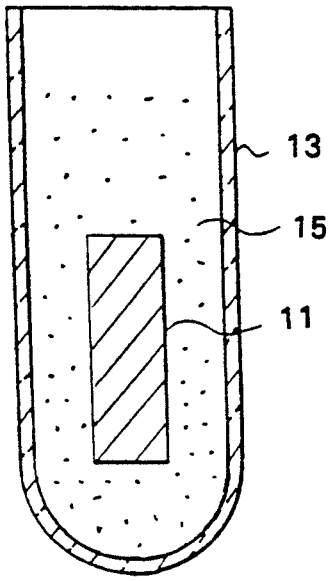
FIG. 3 is a vertical sectional view of a shaped body containing vessel which is used in the method mentioned in connection with FIG. 2.

Turning to FIG. 3 during a short while, the shaped body is illustrated at 11. As a reaction vessel, a glass vessel 13 was used. The glass vessel 13 was made of borosilicate glass, which is well-known by a trade name of Pyrex glass and has a softening point at 770° C. Aluminium oxide powder was first put in the glass vessel 13 for later use as a filler. The shaped body 11 was pushed into the aluminium oxide powder filling the glass vessel 13. The aluminium oxide powder should keep the shaped body 11 out of contact with the glass vessel 13 by surrounding the shaped body 11 in the manner depicted at 15. The aluminium oxide powder 15 need not have a specific packing density. In other words, the packing density is not critical. In this manner, a shaped body containing vessel was provided as shown.

Figure 4:
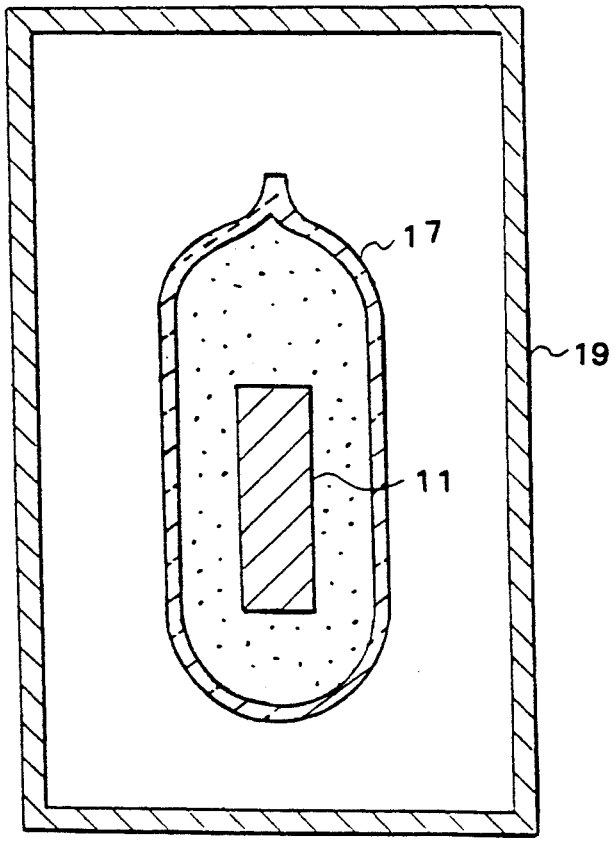
FIG. 4 is a schematic vertical sectional view of a sealed vessel which is placed in a hot isostatic press treatment furnace during progress of the method mentioned in conjunction with FIGS. 2 and 3.

Further turning to FIG. 4, the shaped body containing vessel was evacuated to a vacuum degree of $10^{-5}$ Torr. After evacuated, the shaped body containing vessel was sealed to provide a sealed vessel 17. The sealed vessel 17 was placed in a hot isostatic press (HIP) treatment furnace 19. It should be known that the sealed vessel 17 was supported in the furnace 19 by a support (not shown).

Turning back to FIG. 2, vacuum sealing of the shaped body in the glass vessel is depicted at a fourth step S4. The shaped body in the sealed vessel was now subjected to a hot isostatic press treatment at a fifth step S5.

Figure 5:
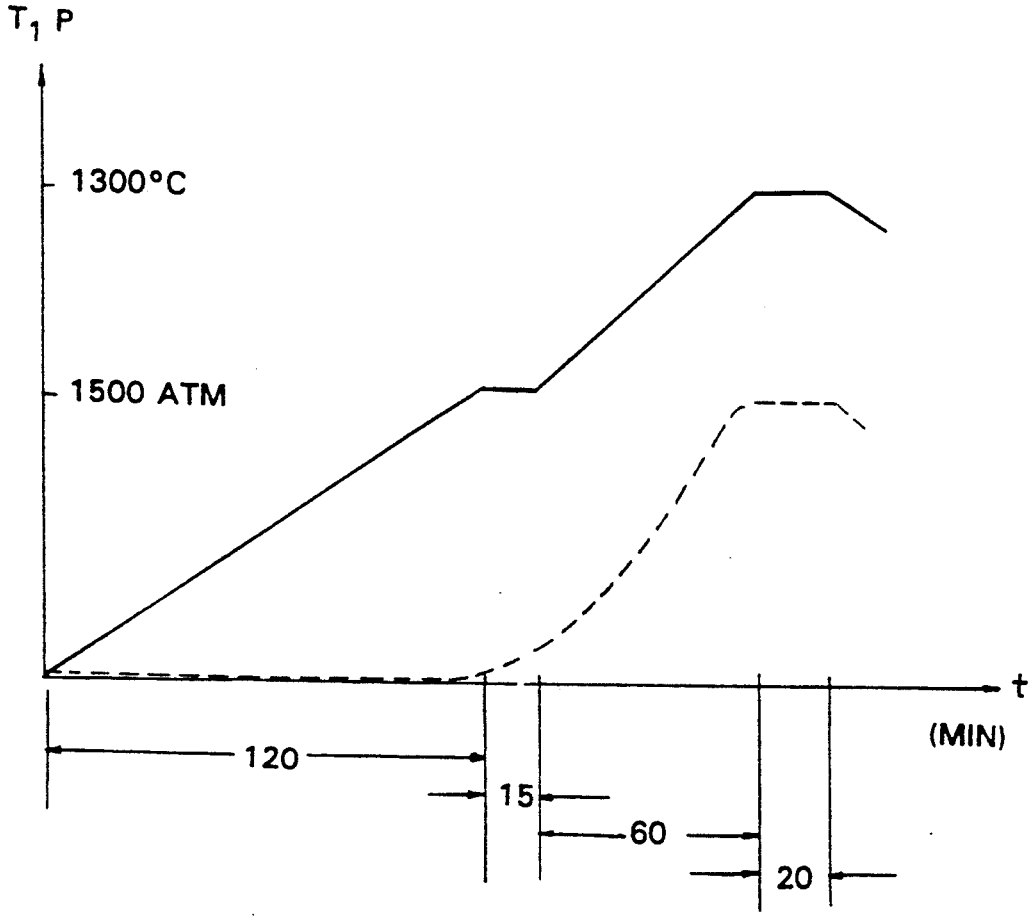
FIG. 5 schematically shows a temperature and pressure raising schedule of a hot isostatic press treatment that is used in the method mentioned in connection with FIGS. 2 through 4.

Turning to FIG. 5 with FIGS. 2 through 4 continuously referred to, a temperature and pressure raising schedule is exemplified with time t scaled along the abscissa in minutes and with temperature T and pressure P scaled along the ordinate in °C. and in atmosphere (atm). The schedule is for processing the hot isostatic press treatment at the fifth step S5.

At the fifth step S5, the sealed vessel 17 was first placed in the hot isostatic press treatment furnace 19 in an argon atmosphere of a current temperature of room temperature and a pressure of one atmosphere. The current temperature was monotonously raised up towards the softening point of the glass vessel 13, namely, towards 770° C., in about 120 minutes.

Subsequently, the current temperature was kept substantially at the softening point for about fifteen minutes. The glass vessel 13 became soft. In the meantime, the pressure was monotonously raised so that the shaped body 11 began subjected to an isostatic pressure through the glass vessel 13 and the aluminium oxide powder 15 surrounding the shaped body 11.

The current temperature was further raised in about sixty minutes up to a final temperature of 1300° C. with the pressure monotonously raised up above 200 atmospheres. The sealed vessel 17 was kept substantially at the final temperature with the pressure maintained at a predetermined atmosphere such as 1500 atmospheres for about twenty minutes. In this manner, the shaped body 11 was sintered at the fifth step S5 into a sintered body of the cathode forming powder.

According to the improved method mentioned before, the shaped body is likewise subjected to a hot isostatic press treatment and is thereby sintered into a sintered body of cathode forming powder. The sealed vessel is maintained at a substantially constant final temperature of 1000° C. for ninety minutes in an argon atmosphere of 1500 atmospheres. With regard to the method being illustrated, the substantially constant final temperature will later be discussed. The sealed vessel 17 is, however, kept at the final temperature for only twenty minutes even when the final temperature is 1000° C.

Turning back again to FIG. 2, the sintered body was machined at a sixth step S6 into pellets. Each pellet should have a predetermined shape and preselected dimensions and has a surface onto which surplus electron emissive substance undesiredly attaches. Each pellet was therefore surface-cleaned at a seventh step S7 to remove the surplus electron emissive substance. In this manner, each pellet became an impregnated cathode. At an eighth step S8, the impregnated cathode was assembled in a thermoelectronic tube.

Figure 6:
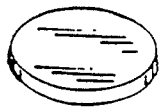
FIG. 6 is an enlarged perspective view of an impregnated cathode.

Referring to FIG. 6, the impregnated cathode may have a cylindrical shape of a diameter of from 1.0 to 1.5 mm and a thickness of from 0.3 to 0.7 mm. Depending on the circumstances, the impregnated cathode may have a concave surface. It should be understood that the impregnated cathode is depicted in FIG. 6 as a porous tungsten matrix. The electron emissive substance is interspersed in the matrix in the manner depicted in the Falce patent mentioned heretobefore although the impregnated cathode of Face includes an additional constituent of iridium as a part of the matrix with an alkaline earth aluminate active material used as the electron emissive substance.

Figure 7:
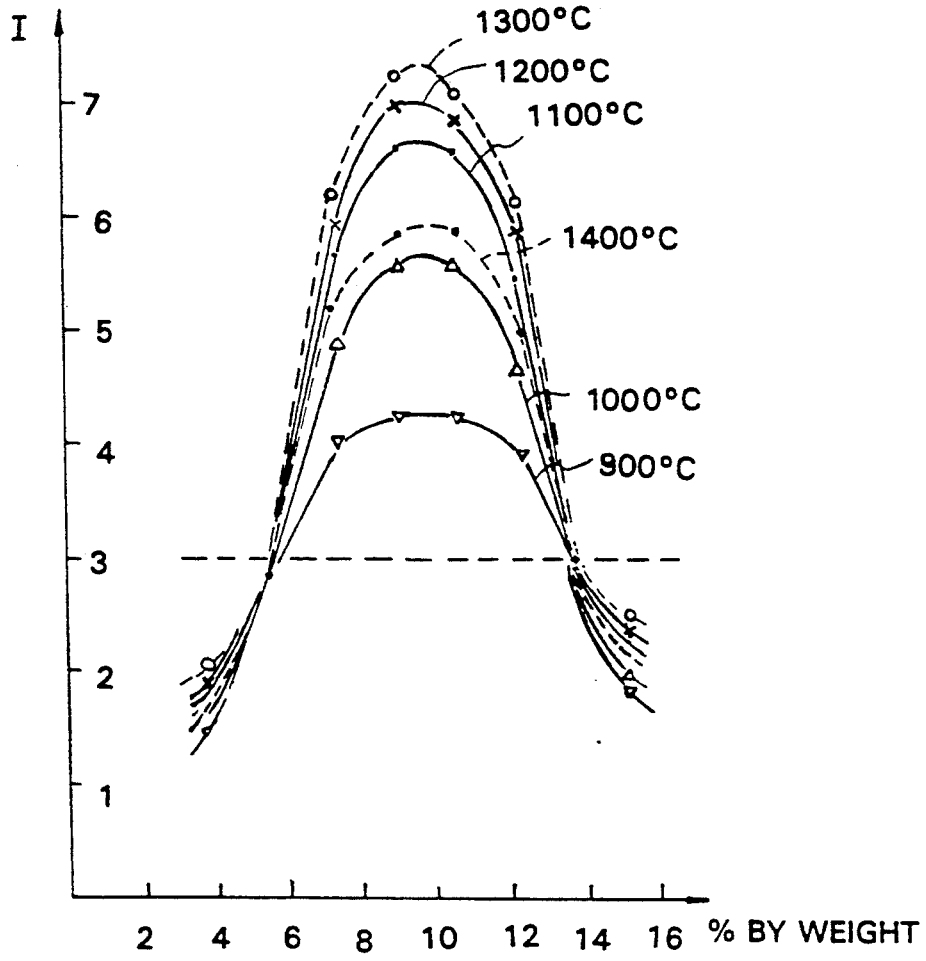
FIG. 7 shows electron emission current densities of impregnated cathodes which are manufactured by the method mentioned in conjunction with FIGS. 2 through 4.

Referring now to FIG. 7, various impregnated cathodes were manufactured with amounts of the electron emissive substance varied in the cathode forming powder in the manner scaled along the abscissa by percent by weight and with the substantially constant final temperature of the hot isostatic press treatment varied as indicated by labels attached to curves. The tungsten powder of 100 g was used as before. In addition to 6 g (5.7 percent by weight), 4 g (3.8 percent by weight), 8 g (7.4 percent by weight), 10 g (9.1 percent by weight), 12 g (10.7 percent by weight), 14 g (12.3 percent by weight), 16 g (13.8 percent by weight), and 18 g (15.3 percent by weight) of the electron emissive substance were used. Besides 1300° C., 900° C., 1000° C., 1100° C. 1200° C., and 1400° C. were used as the final temperature. After assembled in electron tubes, the impregnated cathodes were tested as regards their electron emission current densities I which are scaled along the ordinate in an arbitrary scale.

It is understood from FIG. 7 that the electron emission current density is greater than that attained by prior art as indicated by a horizontal dashed line when the amount of the electron emissive substance is greater than 5.7 percent by weight and is not greater than 13.8 percent by weight. It is furthermore understood that the substantially constant final temperature is preferably at least 900° C.

It has now been confirmed that the barium aluminate compound of the general chemical formula hardly reacts with tungsten during and after the hot isostatic press treatment in contrast to barium oxide. Furthermore, the electron emissive substance does not include barium carbonate.

As for the substantially constant final temperature of the hot isostatic press treatment, it has been confirmed that the sintered body has an optimum mechanical strength when the final temperature is at least 900° C. The optimum mechanical strength is such that the sintered body can readily be machined into the pellets of the impregrated cathodes. Below 900° C., the mechanical strength is insufficient even if the amount of the electron emissive substance is greater than 5.7 percent by weight and is not greater than 13.8 percent by weight. The sintered body has a higher mechanical strength when the final temperature is higher than 1400° C. The barium aluminate compound, however, reacts with tungsten in this event to undesiredly become the tungstate. As a consequence, it has been confirmed that the substantially constant final temperature should not be lower than 900° C. or higher than 1400° C.

While this invention has thus far been described in specific conjunction with a single embodiment thereof, it will now be readily possible for one skilled in the art to put this invention into practice in various other manners. For example, the metal powder may be molybdenum powder or tantalum powder. On preparing the electron emissive substance, the powder of barium carbonate, calcium carbonate, and aluminium oxide may be mixed in different mol ratios and fired in different atmospheres at different temperatures for different intervals of time provided that the electron emissive substance comprises a barium aluminate compound of the general chemical formula. The electron emissive substance may additionally include a small total amount of barium oxide, barium carbonate, calcium oxide, and others.

What is claimed is:

1. A method of manufacturing an impregnated cathode comprising the steps of mixing metal powder of a high melting point and a heat resistive property and an electron emissive substance in a dry state into cathode forming powder, press-shaping said cathode forming powder into a shaped body, sealing said shaped body in a reaction vessel to provide a sealed vessel, subjecting the shaped body in said sealed vessel to a hot isostatic press treatment to change said shaped body to a sintered body of said cathode forming powder by keeping said sealed vessel at a substantially constant final temperature which is not lowered than 900° C. and is not higher than 1400° C., and machining said sintered body into said impregnated cathode, wherein said electron emissive substance comprises a barium aluminate compound represented by a chemical formula of:

$$(pBaO.qCaO).nBaAl_2O_4,$$

where p represents an integer which is not less than one, q represents an integer which is not less than zero, n represents an integer which is not less than one and which compound does not react with said high melting point metal powder during said hot isostatic press treatment.

2. A method as claimed in claim 1, wherein the step of subjecting said shaped body to the hot isostatic press treatment is carried out by keeping said sealed vessel at said substantially constant temperature in an argon atmosphere of 200 or more atmospheres for about twenty minutes.

3. A method as claimed in claim 2, wherein the step of subjecting said shaped body to the hot isostatic press treatment is carried out by selecting 1300° C. as said substantially constant final temperature.

4. A method as claimed in claim 3, wherein said reaction vessel is made of glass which has a softening point lower than said substantially constant final temperature and withstands said substantially constant final temperature.

5. A method as claimed in claim 4, wherein the step of subjecting said shaped body to the hot isostatic press treatment is carried out by placing said sealed vessel in an argon atmosphere of a pressure of one atmosphere, heating said sealed vessel in about 120 minutes monotonously up to a current temperature which is substantially equal to said softening point, keeping said sealed vessel at said current temperature for about fifteen minutes, raising said current temperature monotonously up to said substantially constant final temperature in about sixty minutes, and raising said pressure monotonously up to above 200 atmospheres while said current temperature is kept substantially at said softening point and then raised to said substantially constant final temperature.

6. A method as claimed in claim 2, wherein the step of sealing said shaped body in said reaction vessel is carried out by putting aluminium oxide powder in said reaction vessel, pushing said shaped body into the aluminium oxide powder filling said reaction vessel to provide a shaped body containing vessel, evacuating said shaped body containing vessel to provide an evacuated vessel, and sealing said evacuated vessel into said sealed vessel.

7. A method as claimed in claim 6, wherein the step of sealing said shaped body in said reaction vessel is carried out by evacuating said shaped body containing vessel to about $10^{-5}$ Torr.

8. A method as claimed in claim 1, wherein the step of mixing said metal powder and said electron emissive substance is carried out to make said cathode forming powder include said electron emissive substance in a ratio which is greater than 5.7 percent by weight and is not greater than 13.8 percent by weight.

9. A method as claimed in claim 8, wherein the step of mixing said metal powder and said electron emissive substance is carried out by selecting the metal powder having an average powder diameter between 2 and 10 microns and by making said electron emissive substance have an average powder diameter between 0.1 micron and 2.0 microns in said cathode forming powder.

10. A method as claimed in claim 9, wherein the step of mixing said metal powder and said electron emissive substance is carried out at a temperature which is lower than said high melting point.

11. A method as claimed in claim 9, wherein said metal powder is powder of a metal selected from tungsten, molybdenum, and tantalum.

12. A method as claimed in claim 9, wherein said electron emissive substance is prepared by mixing barium carbonate powder, calcium carbonate powder, and aluminium oxide powder in a mol ratio of 4:1:1 into mixed powder and firing said mixed powder in air at 1100° C. for five to ten hours.

13. A method as claimed in claim 1, wherein the step of press-shaping said cathode forming powder into said shaped body is carried out by subjecting said cathode forming powder to rubber press of about 2 tons per square centimeter.

14. An impregnated cathode comprising a porous matrix of a metal having a high melting point and a heat resistive property, and an electron emissive substance impregnating said porous matrix, wherein said electron emissive substance comprises a barium aluminate compound represented by a chemical formula of:

$$(pBaO.qCaO).nBaAl_2O_4,$$

where p represents an integer which is not less than one, q representing an integer which is not less than zero, n representing an integer which is not less than one.

15. An impregnated cathode as claimed in claim 14, wherein said impregnated cathode includes said electron emissive substance in a ratio which is greater than 5.7 percent by weight and is not greater than 13.8 percent by weight.

16. An impregnated cathode as claimed in claim 14, wherein said metal is selected from tungsten, molybdenum, and tantalum.

17. An impregnated cathode manufactured by a method comprising the steps of mixing metal powder of a high melting point and a heat resistive property and an electron emissive substance in a dry state into cathode forming powder, press-shaping said cathode forming powder into a shaped body, sealing said shaped body in a reaction vessel to provide a sealed vessel, subjecting the shaped body in said sealed vessel to a hot isostatic press treatment to change said shaped body to a sintered body of said cathode forming powder by keeping said sealed vessel at a substantially constant final temperature which is not lower than 900° C. and is not higher than 1400° C., and machining said sintered body into said impregnated cathode, wherein said electron emissive substance comprises a barium aluminate compound represented by a chemical formula of:

$$(pBaO.qCaO).nBaAl_2O_4,$$

where p represents an integer which is not less than one, q represents an integer which is not less than zero, n represents an integer which is not less than one and which compound does not react with said high melting point metal powder during said hot isostatic press treatment.

18. An impregnated cathode as claimed in claim 17, wherein the step of subjecting said shaped body to the hot isostatic press treatment is carried out by keeping said sealed vessel at said substantially constant final temperature in an argon atmosphere of 200 or more atmospheres for about twenty minutes.

19. An impregnated cathode as claimed in claim 18, wherein the step of subjecting said shaped body to the hot isostatic press treatment is carried out by selecting 1300° C. as said substantially constant final temperature.

20. An impregnated cathode as claimed in claim 18, wherein said reaction vessel is made of glass which has a softening point lower than said substantially constant final temperature and withstands said substantially constant final temperature.

21. An impregnated cathode as claimed in claim 20, wherein the step of subjecting said shaped body to the hot isostatic press treatment is carried out by placing said sealed vessel in an argon atmosphere of a pressure of one atmosphere, heating said sealed vessel in about 120 minutes monotonously up to a current temperature which is substantially equal to said softening point, keeping said sealed vessel at said current temperature for about fifteen minutes, raising said current temperature monotonously up to said substantially constant final temperature in about sixty minutes, and raising said pressure monotonously up to above 200 atmospheres while said current temperature is kept substantially at said softening point and then raised to said substantially constant final temperature.

22. An impregnated cathode as claimed in claim 18, wherein the step of sealing said shaped body in said reaction vessel is carried out by putting aluminium oxide powder in said reaction vessel, pushing said shaped body into the aluminium oxide powder filling said reaction vessel to provide a shaped body containing vessel, evacuating said shaped body containing vessel to provide an evacuated vessel, and sealing said evacuated vessel into said sealed vessel.

23. An impregnated cathode as claimed in claim 22, wherein the step of sealing said shaped body in said reaction vessel is carried out by evacuating said shaped body containing vessel to about $10^{-5}$ Torr.

24. An impregnated cathode as claimed in claim 17, wherein the step of mixing said metal powder and said electron emissive substance is carried out to make said cathode forming powder include said electron emissive substance in a ratio which is greater than 5.7 percent by weight and is not greater than 13.8 percent by weight.

25. An impregnated cathode as claimed in claim 24, wherein the step of mixing said metal powder and said electron emissive substance is carried out by selecting the metal powder having an average powder diameter between 2 and 10 microns and by making said electron emissive substance have an average powder diameter between 0.1 micron and 2.0 microns in said cathode forming powder.

26. An impregnated cathode as claimed in claim 25, wherein the step of mixing said metal powder and said electron emissive substance is carried out at a temperature lower than said high melting point.

27. An impregnated cathode as claimed in claim 25, wherein said metal powder is powder of a metal selected from tungsten, molybdenum, and tantalum.

28. An impregnated cathode as claimed in claim 17, wherein said electron emissive substance is prepared by mixing barium carbonate powder, calcium carbonate powder, and aluminium oxide powder in a mol ratio of 4:1:1 into mixed powder and firing said mixed powder in air at 1100° C. for five to ten hours.

* * * * *